US009174485B2

(12) United States Patent
Lareau

(10) Patent No.: US 9,174,485 B2
(45) Date of Patent: Nov. 3, 2015

(54) ARTISTIC MEDIA STRETCHING DEVICE

(71) Applicant: Daniel R Lareau, Las Vegas, NV (US)

(72) Inventor: Daniel R Lareau, Las Vegas, NV (US)

( * ) Notice: Subject to any disclaimer, the term of this patent is extended or adjusted under 35 U.S.C. 154(b) by 0 days.

(21) Appl. No.: 14/484,010

(22) Filed: Sep. 11, 2014

(65) Prior Publication Data

US 2015/0068075 A1 Mar. 12, 2015

Related U.S. Application Data

(60) Provisional application No. 61/877,064, filed on Sep. 12, 2013.

(51) Int. Cl.
*B44D 3/18* (2006.01)
*D06C 3/08* (2006.01)
*D06F 59/08* (2006.01)

(52) U.S. Cl.
CPC *B44D 3/185* (2013.01); *D06C 3/08* (2013.01); *D06F 59/08* (2013.01)

(58) Field of Classification Search
CPC ..... B44D 3/18; B44D 3/185; B41F 15/34; B41F 15/36; D06F 59/00; D06F 59/08; D06C 3/08
USPC ..... 38/102.5, 102.91
See application file for complete search history.

(56) References Cited

U.S. PATENT DOCUMENTS 2,595,595 A * 5/1952 McKay ..... 49/418
3,255,540 A * 6/1966 Gilman ..... 38/102.91
3,482,343 A * 12/1969 Hamu ..... 38/102.5
3,507,062 A * 4/1970 Moyer ..... 38/102.91
3,553,862 A * 1/1971 Hamu ..... 38/102.1
3,774,326 A * 11/1973 Selden ..... 38/102.4
4,277,901 A 7/1981 Williams
4,862,610 A 9/1989 Lawless
5,063,842 A * 11/1991 Clarke ..... 101/127.1
5,330,143 A * 7/1994 Rich et al. ..... 248/161
5,852,974 A * 12/1998 Egan et al. ..... 101/127.1
6,269,562 B1 8/2001 Jacob
6,493,968 B2 * 12/2002 Chinitz ..... 38/102.91
2009/0217557 A1 9/2009 Serrano
2012/0186114 A1 7/2012 Boggs

* cited by examiner

*Primary Examiner* — Ismael Izaguirre

(74) *Attorney, Agent, or Firm* — Daniel Boudwin; Global Intellectual Property Agency LLC

(57) ABSTRACT

Disclosed is a stretching device for artistic media, which includes a pair of horizontal and vertical frame members. The horizontal frame members and the vertical frame members can be removably connected by means of L-shaped joints to form a rectangular frame. Each of the horizontal frame members and the vertical frame members include an upper flat bar and a lower flat bar slideably attached thereto by means of slide screws. The upper flat bar and the lower flat bar can be brought closer together so as to hold an edge of a piece of paper therebetween by adjusting clamping screws affixed thereto. The upper flat bar and the lower flat bar can be moved away from the horizontal frame member or the vertical frame member by means of stretch knob screws. In one embodiment, the device may be utilized to stretch watercolor paper and prevent the paper from wrinkling.

9 Claims, 4 Drawing Sheets

ARTISTIC MEDIA STRETCHING DEVICE

CROSS REFERENCE TO RELATED APPLICATION

This application claims the benefit of U.S. Provisional Application No. 61/877,064 filed on Sep. 12, 2013. The above identified patent application is herein incorporated by reference in its entirety to provide continuity of disclosure.

BACKGROUND OF THE INVENTION

1. Field of the Invention

The present invention relates to an artistic media stretching device. More specifically, the present invention pertains to an improved artistic media stretching device for stretching watercolor paper and preventing the paper from wrinkling or otherwise buckling. The device may be utilized with the paper prior to painting on the paper or during the painting process.

Stretching watercolor paper or other artistic media such as canvas has many aesthetic advantages because stretching provides a flat surface on which to work, and the surface remains relatively flat during and after the painting process. Many stretching techniques include the steps of submerging the paper in water and soaking the paper so that the paper is sufficiently damp before it is placed on a stretching device. Thereafter, the paper may be installed on a stretching device so that the edges of the paper are secured to the perimeter of the device and the surface of the paper is taut.

However, it is difficult to stretch paper so that the paper is stretched uniformly and does not warp. Conventional stretching devices comprise a clamping mechanism for securing the edges of the paper. When damp paper is installed on a stretching device with a clamping mechanism, however, the paper does not stay flat. This can be problematic as it is impracticable to continually attempt to flatten the paper while it is secured on the stretching device. Additionally, it is not ideal to remoisten paper because constantly remoistening paper causes the wrinkles to worsen. Accordingly, existing stretching devices do not allow users to eliminate wrinkling on the paper while it is wet.

The present invention relates to a stretching device for artistic media, and in particular, watercolor paper. While the present invention is particularly useful for stretching watercolor paper, the present invention may also be used for stretching other types of artistic media, such as canvas, fabrics, awnings, and the like. Generally, the present invention comprises a pair of horizontal frame members and a pair of vertical frame members that form a frame, and a pair of flat bars that are on the outer surface of the frame, wherein the flat bars slide towards and away from the horizontal and vertical frame members. The present invention further includes a set of slide screws that help guide the flat bars when sliding towards and away from the horizontal and vertical frame members. The flat bars may be brought closer together or further apart by means of clamping screws, so as to secure a watercolor paper therebetween. Once the paper is secured to the device, the flat bars can be moved away from the frame by means of stretch knob screws to stretch the surface of the paper and eliminate any wrinkles thereon. Thereafter, the stretch knob screws may be further adjusted so that the user can increase or decrease the tension on the surface of the paper during the painting process. This enables the user to maintain a flat painting surface without removing the paper from the device. Additionally, the present invention allows the user to prevent the paper from wrinkling even when the paper is remoistened.

2. Description of the Prior Art

Devices have been disclosed in the prior art that claim watercolor paper stretchers. These include devices that have been patented and published in patent application publications. Some of these devices disclose a stretcher that includes a frame, anchors, and a screw that tightens the paper. Other devices disclose a frame with brackets that attach to each corner of the frame. These devices, however, do not utilize a sliding bar that can be adjusted to stretch the paper. The foregoing is a list of devices deemed most relevant to the present disclosure, which are herein described for the purposes of highlighting and differentiating the unique aspects of the present invention, and further highlighting the drawbacks existing in the prior art.

Specifically, U.S. Pat. No. 6,269,562 to Jacob discloses a sheet stretching device comprising a flat board and a frame assembly. The board comprises a plurality of apertures along the perimeter thereof, and a plurality of slots that is spaced at regular intervals. The frame assembly includes a mechanism that bends the board into a disk shape. When the board is shaped into a disk, a sheet of material is affixed to the board with anchors. When the frame is released from the board, the board resumes its original shape and the sheet is stretched. While the device of Jacob is capable of stretching a sheet of material such as a sheet of watercolor paper, the device of Jacob differs from the present invention in that Jacob fails to disclose a frame having a pair of slideably attached flat bars at each of its sides. The flat bars of the present invention helps secure the paper in place, thereby eliminating the need to use a board.

Similarly, U.S. Published Patent Application Number 2012/0186114 to Boggs discloses a watercolor paper stretcher and holder device comprising a board, and a channel edging at each of its sides. The channel edging is constructed so that it fits snugly onto the sides of the board. Thus, Boggs does not disclose a plurality of fasteners for securing the channel edging in place. In contrast, the present invention comprises a frame and a pair of flat bars at each of its sides. The flat bars are slideably attached to the sides of the frame via slide screws, clamping screws, and stretch knob screws. In this way, the user can adjust the tension of the paper secured onto the frame when stretching the paper.

U.S. Pat. No. 4,862,610 to Lawless discloses a watercolor paper constrainer comprising a rectangular base defined by constraining straps and tightening screws capable of constraining a watercolor paper at the edge-line to obtain a fully flat sheet for painting. Although the tightening screws serve to draw the constraining strap into intimate contact with the watercolor paper and the base, the device of Lawless is limited in the fact that it does not disclose slide screws, clamping screws, and stretch knob screws. Each of the screws of the present invention are used for different purposes. For instance, the slide screws of the present invention assist the user in guiding the flat bars that are disposed at each of the sides of the frame. Additionally, the clamping screws assist the user in securing the edges of the paper. Lastly, the stretch knob screws assist in stretching the paper so as to reduce the paper from wrinkling.

U.S. Pat. No. 4,277,901 to Williams discloses a watercolor paper stretcher comprising a box-like frame with a cover having sides that extend downwardly therefrom. The box-like frame comprises a plurality of anchor means at the lower perimeter thereof. A watercolor paper is disposed between the frame and the cover so that the edges of the watercolor paper are secured to each of the anchor means. In this way, the device of Williams stretches the watercolor paper. Unlike the present invention, however, the device of Williams does not secure the watercolor paper by means of screws. The present invention comprises various types of screws to secure the watercolor paper to the device while stretching the paper.

Finally, U.S. Published Patent Application Number 2009/0217557 to Serrano discloses an artistic media stretcher comprising a frame on which the medium is stretched and a hinged clamping mechanism that is adapted to both stretch the medium and to secure the medium to the frame. The hinged clamping mechanism may comprise a double-hinged, single-hinged, tongue-and-catch, a barbell-hinged, half-barbell hinged, and a hybrid-hinged clamping mechanism. Thus, the device of Serrano does not disclose a frame having a pair of flat bars slideably attached thereto by means of a plurality of screws. The present invention discloses clamping screws that secure the watercolor paper to the frame, and stretch knob screws that stretch the watercolor paper. As such, the present invention comprises different types of screws that function separately. In contrast, the device of Serrano uses a single type of hinged clamping mechanism to secure and stretch the medium to the frame.

The devices disclosed in the prior art have several known drawbacks. These devices are limited in that these devices fail to provide a separate means to secure the watercolor paper and to stretch the watercolor paper. The present invention overcomes these limitations by disclosing clamping screws and stretch knob screws, wherein the clamping screws secure the watercolor paper to the frame and the stretch knob screws stretch the watercolor paper to prevent wrinkling. Additionally, the present invention discloses a frame with slideably attached flat bars that are guided into position by means of slide screws. In this way, the flat bars are aligned properly to the frame, which further assist in preventing the watercolor paper from wrinkling or folding. It is therefore submitted that the present invention is substantially divergent in design elements from the prior art, and consequently it is clear that there is a need in the art for an improvement to paper stretchers. In this regard, the instant invention substantially fulfills these needs.

SUMMARY OF THE INVENTION

In view of the foregoing disadvantages inherent in the known types of paper stretchers now present in the prior art, the present invention provides a new and improved artistic media stretching device wherein the same can be utilized for stretching paper.

It is therefore an object of the invention to provide a new and improved artistic media stretching device that has all of the advantages of the prior art and none of the disadvantages.

Another object of the present invention is to provide a new and improved artistic media stretching device having a frame and slideable bars attached thereto by means of a plurality of fasteners.

Yet another object of the present invention is to provide a new and improved artistic media stretching device that can be easily assembled and disassembled by means of removably attached joints.

Still yet another object of the present invention is to provide a new and improved artistic media stretching device having fasteners that are configured to prevent disengagement therefrom.

Still yet another object of the present invention is to provide a new and improved artistic media stretching device that holds and stretches paper, canvas, needle point cloth, and other similar sheet of material to prevent wrinkling and without damaging the same.

Still yet another object of the present invention is to provide a new and improved artistic media stretching device that may be readily fabricated from materials that permit relative economy and are commensurate with durability.

Other objects, features, and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein the numeral annotations are provided throughout.

DETAILED DESCRIPTION OF THE INVENTION

Figure 1:
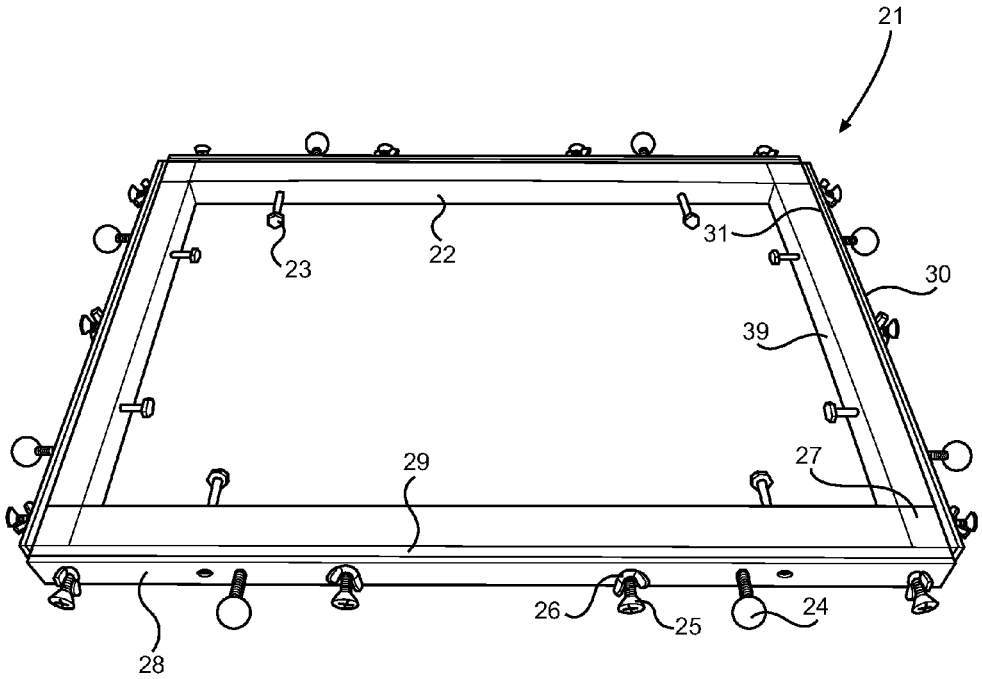
FIG. 1 shows an assembled view of the present invention.

References are made herein to the attached drawings. Like reference numerals are used throughout the drawings to depict like or similar elements of the paper stretching device. For the purposes of presenting a brief and clear description of the present invention, the preferred embodiment will be discussed as used to stretch paper. The figures are intended for representative purposes only and should not be considered to be limiting in any respect.

Referring now to FIG. 1, there is shown an assembled view of the present invention. The present invention comprises an artistic media stretching device 21 having a rectangular frame. The frame comprises a pair of vertical frame members 39 and a pair of horizontal frame members 22. Each of the vertical frame members 39 and the horizontal frame members 22 comprise a rectangular cross section with a hollow middle, wherein the cross sectional area of the vertical frame members 39 is substantially equal to the cross sectional area of the horizontal frame members 22. The horizontal frame members 22 and the vertical frame members 39 are composed of aluminum tubing or other rigid, lightweight material. The vertical frame members 39 and the horizontal frame members 22 are removably connected so as to form a rectangular frame. In this way, the present invention may be configured to change the size of the rectangular frame by using vertical frame members and horizontal frame members of different lengths. In a preferred embodiment, the horizontal frame members 22 are parallel to each other and are perpendicular to the vertical frame members 39.

The vertical frame members 39 and the horizontal frame members 22 are connected by means of a joint 27 disposed at each of the corners of the frame. As such, each of the ends of the vertical frame members 39 and each of the ends of the horizontal frame members 22 are connected to the joint 27. When separated from the vertical frame members 39 and the horizontal frame members 22, the joints 27 are substantially L-shaped when viewed from the top, and comprises a rectangular cross section. The cross sectional area of the terminal ends of the joints 27, or where the joints 27 connect to the vertical 39 and horizontal frame members 22 is less than the cross sectional area of the hollow middle of the vertical frame members 39 and the horizontal frame members 22. As such, the terminal ends of the joints 27 is inserted into the hollow middle of the vertical 39 and horizontal frame members 22.

The vertical frame members 39 include an upper flat bar 30 and a lower flat bar 31 thereon. The upper flat bar 30 and the lower flat bar 31 are substantially rectangular in shape and are substantially equal in length. In a preferred embodiment, the length of the upper 30 and lower flat bars 31 is greater than the length of the length of the vertical frame members 39. As such, the ends of the upper 30 and lower flat bars 31 extend beyond the ends of the vertical frame members 39. Further, the upper flat bar 30 and lower flat bar 31 are arranged in a stacked configuration such that the upper flat bar 30 rests flush against the lower flat bar 30 when the flat bars are in a compressed configuration. Additionally, the upper and lower flat bars 30, 31 are disposed on an exterior surface of the vertical frame members.

Each of the upper flat bar 30 and the lower flat bar 31 comprises a first, second, and third sets of apertures having threaded elements therein. The first set of apertures is adapted to receive slide screws 23 therethrough; the second set of apertures is adapted to receive clamping screws 25 therethrough; and the third set of apertures is adapted to receive stretch knob screws 24 therethrough. The sliding screws 23 allow the upper and lower flat bars to move freely therealong, wherein the upper and lower flat bars move independently of one another. The clamping screws 25 are used to adjust the separation between the upper and lower flat bars, and an end of the clamping screw is affixed to the lower flat bar. The clamping screws 25 can be used to secure an edge of a sheet of water color paper between the flat bars 30, 31. The stretch knob screws 24 are used to pull both flat bars 30, 31 away from the rectangular frame so as to create separation between the lower flat bar 31 and the rectangular frame. Thus, an end of the stretch knob screw 24 is affixed to the frame members of the rectangular frame.

Each of the apertures on the upper flat bar 30 are aligned with the apertures on the lower flat bar 31 so as to receive a fastener such as slide screws 23, clamping screws 25, and stretch knob screws 24 therethrough. The vertical frame members 39 comprise a first set of apertures to receive the slide screws 23 therethrough, wherein the apertures on the vertical frame members 39 are aligned with the first set of apertures on the upper 30 and lower flat bars 31. As such, the slide screws 23 extend from the upper flat bar 30 to the vertical frame members 39.

The horizontal frame members 22 comprise an upper flat bar 28 and a lower flat bar 29. Similar to the flat bars 30, 31, the upper 28 and lower flat bars 29 are also substantially rectangular in shape. The upper 28 and lower flat bars 29 are substantially equal in length and width. The length of the upper 28 and lower flat bars 29 is greater than the length of the horizontal frame members 22 such that the ends of the upper 28 and lower flat 29 bars extend beyond the ends of the horizontal frame members 22.

The upper 28 and lower flat bars 29 comprise three sets of apertures having threaded elements therein. The first set of apertures is adapted to receive slide screws 23; the second set of apertures is adapted to receive clamping screws 25; and the third set of apertures is adapted to receive stretch knob screws 24 therethrough. Additionally, the horizontal frame members 22 comprise a first set of apertures adapted to receive slide screws 23 therethrough. The apertures on the horizontal frame members 22 align with the first set of apertures disposed on the upper 28 and lower flat bars 29.

Each of the slide screws 23, clamping screws 25, and stretch knob screws 24 is configured so that it does not disengage from the aperture in which it is disposed, while allowing a loose connection therebetween that allows the screws to pivot or slide with respect to the apertures. Each of the clamping screws 25 and the stretch knob screws 24 does not disengage from the apertures on the upper 30 and lower flat bars 31. Similarly, the slide screws 23 do not disengage from the apertures on the vertical frame members 39. In this way, the fasteners are prevented from loss during use or storage thereof.

Figure 2A:
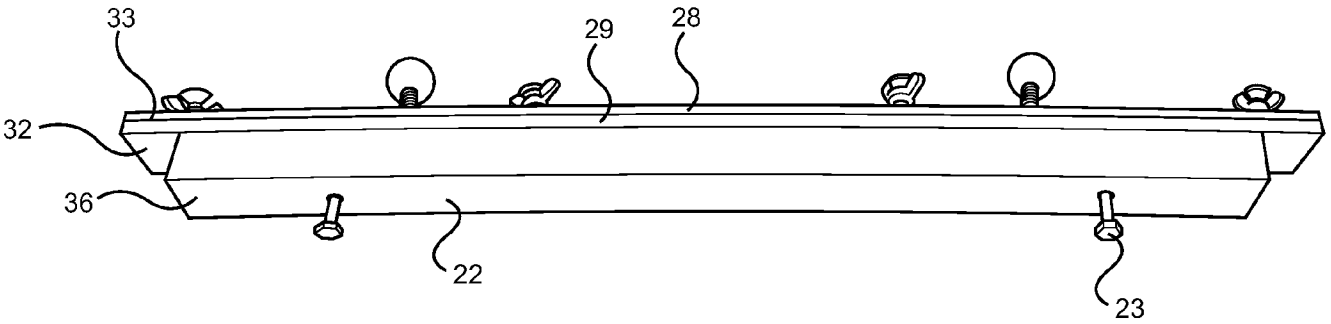
FIG. 2A shows a view of a horizontal frame member in a compressed configuration.
Figure 2B:
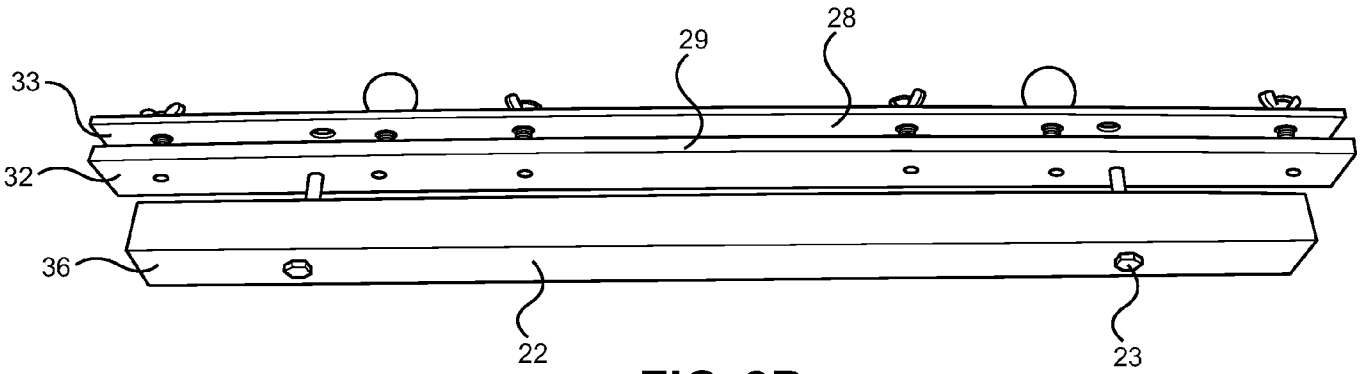
FIG. 2B shows a views of a horizontal frame member in an extended configuration.

Referring now to FIGS. 2A and 2B, there shown views of the horizontal frame members of the artistic media stretching device of the present invention. Each of the horizontal frame members 22 comprises the upper flat bar 28 and the lower flat bar 29 slideably attached thereto via a pair of slide screws 23. It is preferred that the upper flat bar 28 and the lower flat bar 29 are also composed of aluminum tubing or other rigid material. The upper flat bar 28 and the lower flat bar 29 comprise terminal ends 33, 32, respectively. The flat bars 28, 29 are dimensioned so that the ends 33, 32 extend beyond the ends 36 of the horizontal frame member 22. The upper flat bar 28 and the lower flat bar 29 are physically independent from the horizontal frame member 22 so that the upper flat bar 28 and the lower flat bar 29 can be raised and lowered. When the flat bars 28, 29 are raised and lowered, the slide screws help guide the flat bars 28, 29 so that the flat bars 28, 29 remain aligned throughout use.

Figure 3A:
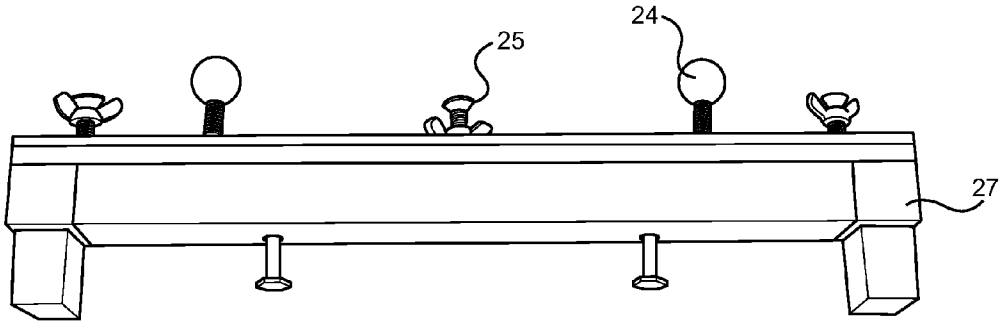
FIG. 3A shows a view of a vertical frame member in a compressed configuration.
Figure 3B:
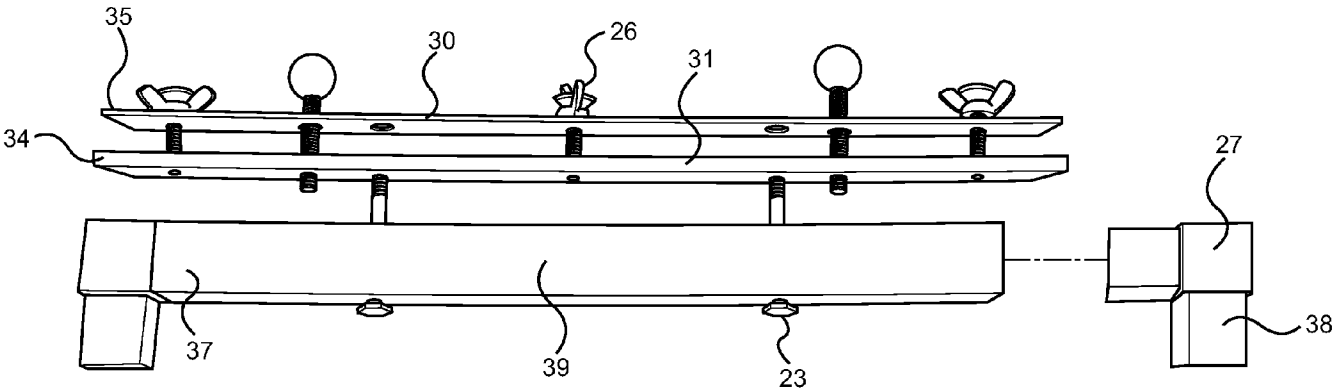
FIG. 3B shows a view of a vertical frame member in an extended configuration.

Referring now to FIGS. 3A and 3B, there shown views of the vertical frame members of the artistic media stretching device of the present invention. The vertical frame members 39 also comprise the upper flat bar 30 and the lower flat bar 31 slideably attached thereto via a pair of slide screws 23, wherein the upper 30 and lower flat bars 31 are composed of aluminum tubing or other suitable material. The upper flat bar 30 and the lower flat bar 31 comprise terminal ends 35, 34, respectively. The flat bars 30, 31 are dimensioned so that the ends 35, 34 extend beyond the ends 37 of the vertical frame member 39. The upper flat bar 30 and the lower flat bar 31 are physically independent from the vertical frame member 39 so that the upper flat bar 30 and the lower flat bar 31 can be raised and lowered. When the flat bars 30, 31 are raised and lowered, the slide screws 23 help guide the flat bars 30, 31 so that the flat bars 30, 31 remain aligned throughout use.

The upper flat bars 28, 30 and the lower flat bars 29, 31 can join or separate by means of clamping screws 25 and wing nuts 26. The wing nuts 26 can move along the length of the clamping screws 25 and push the upper flat bar 28, 30 towards the lower flat bar 29, 31 so that the bottom surface of the upper flat bar 28, 30 is in direct contact with the top surface of the lower flat bar 29, 31. It is contemplated that the end of the clamping screw 25 is affixed to the lower flat bars 29, 31 to prevent disengagement therefrom. The upper flat bar 28, 30 and the lower flat bar 29, 31 can also be moved closer to or further apart from the frame members by means of stretch knob screws 24 having a spherical upper portion that acts as a handle. The stretch knob screws 24 can be adjusted to pull the lower flat bar 29, 31 and the upper flat bar 28, 30 away from the frame members to stretch the paper secured therebetween.

The horizontal frame members 22 and the vertical frame members 39 are removably connected by means of joints 27 that are composed of nylon or other suitable material. Thus, the present invention may be disassembled and stored in a compact manner when it is not in use. The joints 27 are substantially L-shaped when viewed from the top, and comprises a middle portion and two terminal ends 38. The joints 27 comprise a rectangular cross section. The cross sectional area of the terminal ends 38 is less than the cross sectional area of the middle portion. The cross sectional area of the terminal ends 38 is also less than the cross sectional area of the hollow middle portion of the horizontal 22 and vertical frame members 39 so that the terminal ends 38 can be inserted into the hollow middle of the horizontal 22 and vertical frame members 39 at the terminal ends 36, 37 thereof, respectively. It is contemplated that the cross sectional area of the middle portion, or the corner of the joints 27 is substantially equal to the cross sectional area of the horizontal 22 and vertical frame members 39 so that the ends 36, 37 of the horizontal 22 and vertical frame members 39 may jam against the middle portion of the joints 27.

Figure 4:
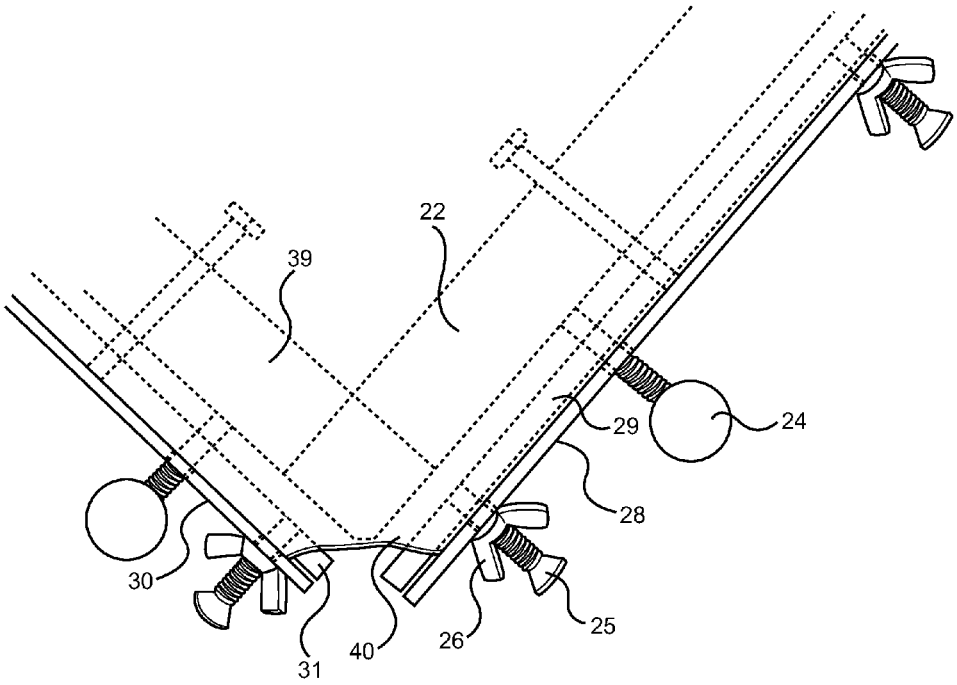
FIG. 4 shows a close up view of a watercolor paper as secured to the present invention.

Referring now to FIG. 4, there is shown a close up view of a watercolor paper 40 as secured to the present invention. It is contemplated that the paper is damp or moistened prior to use. When the paper 40 is damp, the edges of the paper 40 are wedged between the upper flat bars 28, 30, and the lower flat bars 29, 31, and secured in place by means of clamping screws 25 and wing nuts 26. Thereafter, the stretch knob screws 24 are actuated so that the paper 40 is slightly pulled away from the horizontal 22 and vertical frame members 39. In this way, the surface of the paper 40 is taut and prevented from buckling and wrinkling. The stretch knob screws 24 can be adjusted during use so that the user can remove the wrinkles on the paper while working without removing the paper from the device.

It is contemplated that the present invention may be utilized with various types of media, such as canvas, needle point cloth, and the like. In this way, the present invention is designed to increase the versatility of an artistic media stretching device by providing one that can be utilized with a number of different types of medium, and further one that is easily adjustable to regulate the amount of tension exerted upon the medium.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above descriptions then, it is to be realized that the optimum dimensional relationships for the parts of the invention, to include variations in size, materials, shape, form, function, and manner of operation, assembly and use, are deemed readily apparent and obvious to one skilled in the art, and all equivalent relationships to those illustrated in the drawings and described in the specifications are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An artistic media stretching device, comprising:

a rectangular frame comprising a pair of horizontal frame members and a pair of vertical frame members connected by a plurality of joints;

each of said pair of horizontal frame members and said pair of vertical frame members having a first set of apertures;

an upper flat bar and a lower flat bar slideably connected to an exterior surface of each of said pair of horizontal frame members and said pair of vertical frame members;

wherein said upper flat bar and said lower flat bar are arranged in a stacked orientation and are independently movable;

wherein terminal ends of each of said upper flat bar and said lower flat bar extend beyond terminal ends of said rectangular frame;

each of said upper flat bar and said lower flat bar having said first set of apertures, a second set of apertures, and a third set of apertures;

each of said first set of apertures, said second set of apertures, and said third set of apertures having a fastener therein.

2. The artistic media stretching device of claim 1, each of said pair of horizontal frame members and said pair of vertical frame members comprising a rectangular cross section with a hollow middle portion.

3. The artistic media stretching device of claim 2, wherein:

said plurality of joints comprises terminal ends and a middle portion;

each of said terminal ends and said middle portion having a rectangular cross section with a cross sectional area;

said cross sectional area of said terminal ends is less than said cross sectional area of said middle portion of said plurality of joints.

4. The artistic media stretching device of claim 3, wherein:

said cross sectional area of said terminal ends of said plurality of joints is less than a cross sectional area of each of said pair of horizontal frame members and said pair of vertical frame members, such that said terminal ends of said plurality of joints can be inserted into said hollow middle portion of each of said pair of horizontal frame members and said pair of vertical frame members;

said cross sectional area of said middle portion of said plurality of joints is substantially equal to said cross sectional area of each of said pair of horizontal frame members and said pair of vertical frame members.

5. The artistic media stretching device of claim 1, wherein each of said first set of apertures comprises a slide screw therein adapted to allow said upper flat bar and said lower flat bar to move independently thereon.

6. The artistic media stretching device of claim 1, wherein:

each of said second set of apertures comprise a clamping screw with a wing nut thereon;

an end of said clamping screw is affixed to said lower flat bar;

said clamping screw is adapted to bring said upper flat bar and said lower flat bar closer together or further apart.

7. The artistic media stretching device of claim 1, wherein:

each of said third set of apertures comprise a stretch knob screw therein;

said stretch knob screw is adapted to move said upper flat bar and said lower flat bar toward or away from said rectangular frame.

8. The artistic media stretching device of claim 1, wherein said upper flat bar and said lower flat bar are substantially equal in length.

9. The artistic media stretching device of claim 1, wherein said fastener is configured to prevent disengagement from each of said first set of apertures, said second set of apertures, or said third set of apertures.

* * * * *